United States Patent [19]

Santi

[11] 4,063,575

[45] Dec. 20, 1977

[54] PHOTO-ELECTRICALLY OPERATED WEFT FEELER

[75] Inventor: Luciano Santi, Florence, Italy

[73] Assignee: Officine Galileo Meccanotessile S.p.a., Florence, Italy

[21] Appl. No.: 712,062

[22] Filed: Aug. 5, 1976

[30] Foreign Application Priority Data

Aug. 7, 1975 Italy ..... 9511/75

[51] Int. Cl.[2] ..... D03D 51/34

[52] U.S. Cl. ..... 139/370.2

[58] Field of Search ..... 139/370.1, 370.2, 372, 139/377; 66/163; 356/199

[56] References Cited

U.S. PATENT DOCUMENTS

| | | | |
|---|---|---|---|
| 3,049,152 | 8/1962 | Batty et al. | 139/370.1 |
| 3,145,739 | 8/1964 | Metzler | 139/370.1 |
| 3,804,129 | 4/1974 | Bernath | 139/370.2 |
| 3,978,893 | 9/1976 | Inagawa et al. | 139/370.2 |

FOREIGN PATENT DOCUMENTS

| | | | |
|---|---|---|---|
| 2,059,270 | 7/1972 | Germany | 139/370.2 |
| 11,473 | 4/1970 | Japan. | |

*Primary Examiner*—Henry S. Jaudon

[57] ABSTRACT

A weft feeler device for a loom comprising a movable assembly sychronously oscillatable with the loom and carrying a sliding unit on which is mounted a feeler, subjected to the retaining effect of a weft, and a screen. The assembly carries a photo-electric system comprising an optical beam generator and a photo-electric sensor. Upon breakage of a weft thread, the slidable unit is not retained and the screen occupies a position in which it blocks the optical beam.

6 Claims, 4 Drawing Figures

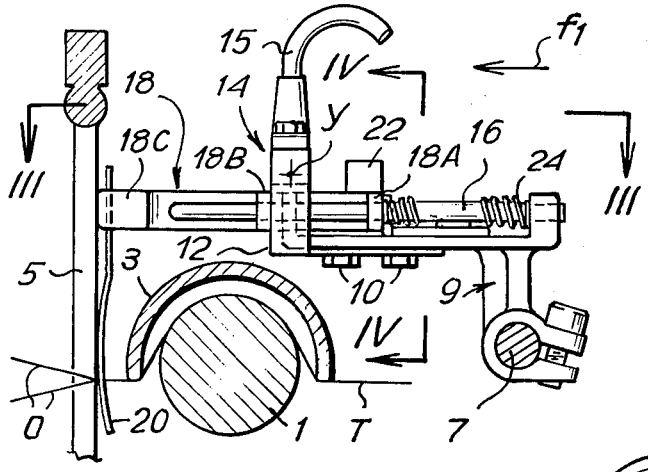
Fig.1
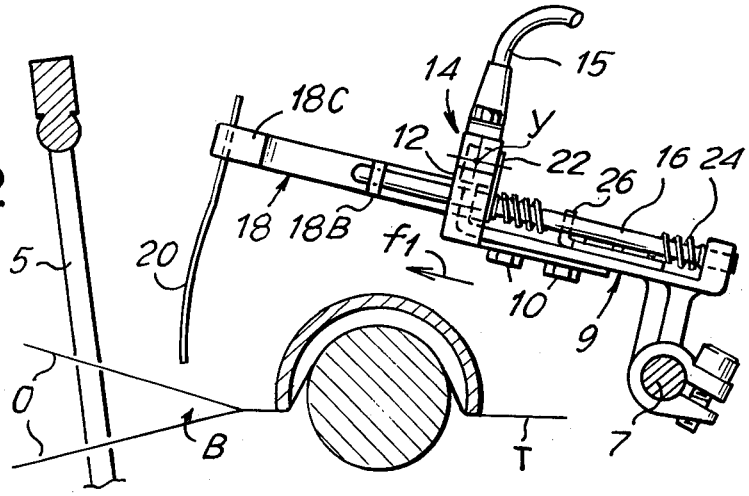
Fig.2
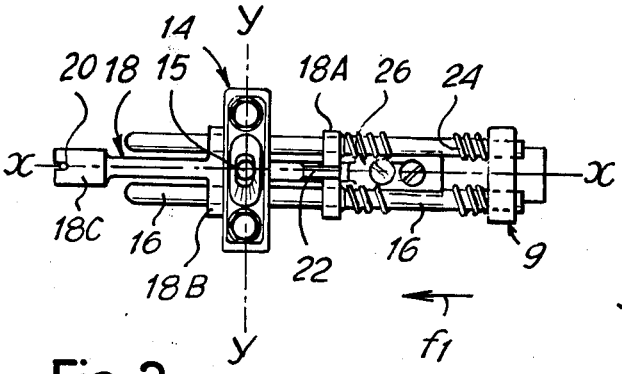
Fig.3
Fig.4
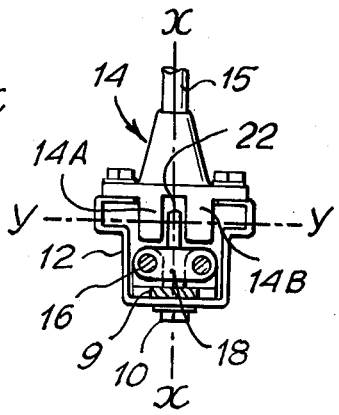

PHOTO-ELECTRICALLY OPERATED WEFT FEELER

FIELD OF THE INVENTION

The present invention relates to a weft feeler for textile looms, to be used, especially but not exclusively in connection with water looms, the weft feeler including a movable unit with a feeler subjected to a retaining effect by the unbroken or entire weft and which can be moved if the weft is broken.

SUMMARY OF THE INVENTION

The invention provides an assembly synchronously oscillating with the loom and bearing a slidable unit with a feeler, a photo-electric system comprising an optical beam generator and a photo-electric sensor, and an intercepting screen, said photo-electric system generating a signal when the feeler is not retained by the weft.

In practice, the oscillating assembly comprises a body provided with two spaced extensions respectively carrying the optical generator and the photo-electric sensor; the screen being mounted on the slidable unit and constituted as a longitudinally oriented finned screen positioned to be inserted in the space between the two extensions to intercept the optical beam.

Said slidable unit may be biased by resilient means to the intercepting position, and it can be stressed by the reed thrust action and by the retaining action of the weft against the action of the resilient means to be displaced to a offset position in which the finned screen is out of the path of the optical beam.

BRIEF DESCRIPTION OF THE DRAWING

The invention will be better understood from the following description and accompanying drawing which illustrates a non-restrictive embodiment. In the drawing:

FIG. 1 is a side view of the device in cooperating condition with the structure of the fabric being formed;

FIG. 2 is similar to FIG. 1 but showing the device in intercepting position;

FIG. 3 is a plan view taken along line III—III in FIG. 1;

FIG. 4 is a section, partly broken away, taken along line IV—IV in FIG 1;

FIG. 5 shows the connection of the device with the sley: and,

FIG. 6 shows the cooperation of the device with the fabric being woven.

DETAILED DESCRIPTION

In the accompanying drawing, T indicates the fabric which is diverted immediately downstream of its formation zone by members 1 and 3, the former being convex and the latter concave. Numeral 5 indicates the reed of the sley, designed to intersect the warps 0 to act on the weft deposited in the warp entry, indicated at B.

The present device is mounted on a shaft 7. The shaft 7 can oscillate in synchronism with the working cycles of the machine as shown in FIG. 5 wherein crank C is connected to trace rod R connected to reed 5 pivotably mounted at 5A. On shaft 7 there is mounted on oscillating assembly 9, which follows the movements synchronized with the loom of the shaft 7. On the assembly 9 there is adjustably mounted, by means of bolts 10, a support 12 for a body 14 including means for generating an optical beam (for instance, an infra-red beam) and for the reception of said beam. In particular, the body 14 has two extensions 14A and 14B (see FIG. 4) which are symmetrical with respect to the plane of axial symmetry of the device (indicated by X—X in FIGS. 3 and 4). One of the two extensions e.g. extension 14A carries the optical beam generator L and the other extension 14B carries the receiving and detecting system F of a photo-electric type, the beam extending along the transverse axis indicated by Y—Y. Numeral 15 indicates a connection cable to energize the generator and to receive signals from the photo-electric detector. The oscillating assembly 9 also includes a pair of guide stems 16 extending perpendicularly to axis Y—Y. A slidable unit 18 is slidably mounted for guided movement on stems 16 and for this purpose has two guide extensions 18A, 18B slidingly mounted on the stems 16. Unit 18 includes a head 18C for a wire feeler 20 which is insertable between two warp threads, and a central finned screen 22, which is adapted to extend into the interspace between the two extensions 14A, 14B and thus intercept the optical beam along the axis Y—Y. Thus, when finned screen 22 is located in the position shown in FIG. 2 it blocks passage of the beam to the receiver irrespective of the angular position of the assembly 9. Springs 24 wound on the guide stems 6 urge the slidable unit 18 in the direction of arrow *f*1, i.e. in the direction to locate the slidable unit in the position of FIG. 2. A thrust force acting in the direction opposite to the arrow *f*1 (opposite the force of the springs 24) can move the unit into the position of FIGS. 1 and 3. A positionally adjustable stop 26 defines the stop position of unit 18 after displacement thereof in a direction opposite to the arrow *f*1.

With angular oscillation of the shaft 7, and thus with oscillation of the assembly 9, the wire feeler 20 is moved from the retracted position (FIG. 2) to the insertion position (FIG. 1), wherein the wire 20 penetrates between two contiguous warps and is subjected to the action of the inserted weft and the sley which carries the weft against the interlacing already formed. More specifically, with reference to FIG. 6, therein can be seen the fabric T already formed, as well as the weft $W_0$ already inserted as last weft into the fabric. The successive weft W, immediately after being laid before the reed 5, is moved thereby in the direction of the arrow *f*10. When the reed 5 and the weft W are away from the fabric T, i.e. the weft $W_0$, the assembly 18, 20 is lowered and the wire 20 is located in back of the weft $W_0$. The reed 5 pushes the weft W to the position shown against the wire 20, also moving the assembly 18, 20 to the illustrated position, against the action of the springs 24 urging said assembly in the direction of the arrow *f*10. When the sley, i.e. the reed 5 is returned in the direction opposite to the arrow *f*10, the weft W has been already tied by the action of the reversal, i.e. the crossing of the warp yarns 0. This weft W therefore prevents the assembly 20, 18 from being thrust by the springs 24 to follow the reed 5 in the direction of the arrow *f*12; this is prevented as long as the wire 20 does not move upwardly again and is released from the fabric. If the weft W is not present or is broken, it does not exert the above braking effect, and the assembly 18, 20 is urged by the springs 24 in the direction of the arrow *f*12, to follow within certain limits the initial movement of the sley 5 in a direction opposite to the arrow *f*10. This different behavior of the assembly 18, 20 in the presence of and in the absence of the sound weft W causes the production of a signal by the action of the screen 22. In the case of a broken weft, the screen 22 comes into alignment with the extensions 14A, 14B *before* this would happen in the case of a sound weft, capable then of resisting the thrust of the springs 24. In other words, if the weft is broken or missing, the assembly 18, 20, 22 advances *before* (rather than after) the wire 20 is lifted. At this state, the slidable unit 18 is moved to the position shown in FIG. 1 wherein the springs 24 are compressed, and the unit 18 is retained by the present weft just inserted and engaged by the warp exchanges. In the absence of the weft or with slackening weft upon the return of the sley from the position of FIG. 1 to the position of FIG. 2 (apart from the angular position of assembly 9), the feeler 20 also retreats, and the unit 18 therewith, back to the position of FIG. 2 with respect to the assembly 9 (not yet raised back). The optical beam between the extensions 14A, 14B is thus intercepted by the finned screen 22, which is in the position of FIG. 2. There is then generated an operational stop signal for the stoppage of the machine due to breakage of the weft or to irregularity in the insertion of the weft. In practice, there may be provided a cam profile on an axle rotating with the loom working cycle, said profile allowing the stopping action in an adjustable set time during a cycle; said allowing action must cease before the wire feeler 20 advances, possible entraining the weft which is only weakly retained by the interlacing of the warps and thus in condition of having a relatively slow advance possibility.

It is contemplated that the drawing only shows an illustration of one embodiment of the invention, which can be varied in form and arrangement without departing from the scope and spirit of the invention.

What is claimed is:

1. A weft feeler device for a loom comprising a movable assembly synchronously oscillatable with the loom and including a feeler subjected to the retaining effect of a weft, a photo-electric system comprising an optical beam generator and a photo-electric sensor, a slidable unit mounting said feeler on said assembly for sliding movement relative to said photo-electric system, and an intercepting screen mounted on said slidable unit for movement with the feeler to block passage of the beam when the feeler is not retained by the weft whereby a signal can then be generated, said assembly further comprising a body with two spaced extensions, one carrying the optical beam generator and the other the photo-electric sensor; said screen being a longitudinally oriented finned screen positioned to be inserted in the space between the two extensions to block the optical beam.

2. A device as claimed in claim 1 comprising resilient means acting on said slidable unit for urging the screen to the blocking position, said unit being subject to the thrust action of the reed of the loom and the retaining action of the weft to be displaced to an offset position in which the finned screen is displaced from the path of the optical beam.

3. A device as claimed in claim 1 wherein said slidable unit is longitudinally slidable, said extensions being transversely spaced apart.

4. A device as claimed in claim 1 comprising guide stems in said assembly, and guide extensions on said slidable unit slidably mounted on said stems.

5. A device as claimed in claim 1 wherein said movable assembly is movable between a raised position in which the feeler is freed from the fabric produced by the loom and a lowered position in which the feeler is inserted in back of the previously inserted weft and is retained by an intact subsequent weft to prevent movement of the slidable unit to a position in which the screen blocks the passage of the beam.

6. A device as claimed in claim 5 comprising resilient means acting on said slidable unit for urging the screen to the blocking position, the intact weft opposing said resilient means to prevent movement of the slidable unit for blocking the optical beam.

* * * * *